US010557182B2

(12) United States Patent
Monroe et al.

(10) Patent No.: US 10,557,182 B2
(45) **Date of Patent: *Feb. 11, 2020**

(54) SYSTEMS AND METHODS FOR TAILORING COEFFICIENTS OF THERMAL EXPANSION BETWEEN EXTREME POSITIVE AND EXTREME NEGATIVE VALUES

(71) Applicant: The Texas A&M University System, College Station, TX (US)

(72) Inventors: James A. Monroe, College Station, TX (US); Ibrahim Karaman, College Station, TX (US); Raymundo Arroyave, College Station, TX (US)

( * ) Notice: Subject to any disclaimer, the term of this patent is extended or adjusted under 35 U.S.C. 154(b) by 379 days.

This patent is subject to a terminal disclaimer.

(21) Appl. No.: 14/897,904

(22) PCT Filed: Jun. 12, 2014

(86) PCT No.: PCT/US2014/042105

§ 371 (c)(1),
(2) Date: Dec. 11, 2015

(87) PCT Pub. No.: WO2014/201239

PCT Pub. Date: Dec. 18, 2014

(65) Prior Publication Data

US 2016/0130677 A1 May 12, 2016

Related U.S. Application Data

(60) Provisional application No. 61/835,289, filed on Jun. 14, 2013.

(51) Int. Cl.
*C21D 8/02* (2006.01)
*C22F 1/08* (2006.01)
(Continued)

(52) U.S. Cl.
CPC ..... *C21D 8/0205* (2013.01); *C21D 8/065* (2013.01); *C22F 1/08* (2013.01); *C22F 1/10* (2013.01); *C22F 1/183* (2013.01)

(58) Field of Classification Search
CPC ..... C21D 9/0068; C21D 8/005
See application file for complete search history.

(56) References Cited

U.S. PATENT DOCUMENTS 3,773,570 A 11/1973 Steinemann et al.
2004/0101394 A1 5/2004 Kang
(Continued)

FOREIGN PATENT DOCUMENTS

JP 2002105561 A * 4/2002

OTHER PUBLICATIONS

Machine Translation of JP 2002-105561 A (Year: 2002).*
(Continued)

*Primary Examiner* — Scott R Kastler
(74) *Attorney, Agent, or Firm* — Kevin Mark Klughart

(57) ABSTRACT

Systems and methods disclosed herein relate to the manufacture of metallic material with a thermal expansion coefficient in a predetermined range, comprising: deforming, a metallic material comprising a first phase and a first thermal expansion coefficient. In response to the deformation, at least some of the first phase is transformed into a second phase, wherein the second phase comprises martensite, and orienting the metallic material in at least one predetermined orientation, wherein the metallic material, subsequent to deformation, comprises a second thermal expansion coefficient, wherein the second thermal expansion coefficient is within a predetermined range, and wherein the thermal expansion is in at least one predetermined direction. In some embodiments, the metallic material comprises the second
(Continued)

phase and is thermo-mechanically deformed to orient the grains in at least one direction.

9 Claims, 14 Drawing Sheets

(51) Int. Cl.

| | |
|---|---|
| ***C22F 1/10*** | (2006.01) |
| ***C21D 8/06*** | (2006.01) |
| ***C22F 1/18*** | (2006.01) |

(56) References Cited

U.S. PATENT DOCUMENTS

| | | | | |
|---|---|---|---|---|
| 2007/0162105 | A1 | 7/2007 | Molaei | |
| 2008/0290141 | A1 | 11/2008 | Shaw et al. | |
| 2009/0042066 | A1 | 2/2009 | Simon et al. | |
| 2011/0162612 | A1 | 7/2011 | Qiao et al. | |
| 2016/0348203 | A1* | 12/2016 | Monroe | C21D 9/0068 |

OTHER PUBLICATIONS

International Patent Application No. PCT/US2014/042105 International Search Report and Written Opinion dated Dec. 17, 2014 (13 pages).

Sarip et al., "Stress Analysis of Laminated Composite Plates with Embedded Shape Memory Alloy Using Finite Element Method," Research Vote No. 75112, Universiti Teknologi Malaysia, pp. 1-155, 2006, available at: http://eprints.utm.my/2992/1/75112.pdf.

Rathod, "Diffraction Studies of Deformation in Shape Memory Alloys and Selected Engineering Components," A dissertation submitted in partial fulfillment of the requirements for the degree of Doctor of Philosophy in the Department of Mechanical Materials and Aerospace Engineering in the College of Engineering and Computer Science at the University of Central Florida, Orlando, Florida, pp. 1-158, 2005, available at http://etd.fcla.edu/CF/CFE0000723/Rathod_Chandrasen_R_200509_PhD.pdf.

Liu, Zi-Kui, et al., "Origin of Negative Thermal Expansion Phenomenon in Solids," Scripta Materialia, vol. 65 (2011), pp. 664-667 (4 p.).

Jacob, C.W., et al., "The Crystalline Structure of Uranium," Journal of American Chemistry Society, vol. 59, No. 12 (1937), pp. 2588-2591 (4 p.).

Lloyd, Lowell, et al., "Themal Expansion of Alpha Uranium," Journal of Nuclear Materials, vol. 18 (1966), pp. 55-59 (5 p.).

Niinomi, Mitsuo, et al., "Anomalous Characteristics of Ti—Nb—Ta—Zr Alloy for Biomedical Applications," Materials Science Forum, vols. 638-642 (2010), pp. 16-21 (7 p.).

Xu, Xiao, et al., "Anomaly of Critical Stress in Stress-Induced Transformation of NiCoMnIn Metamagnetic Shape Memory Alloy," Applied Physics Letters, vol. 95 (2009), pp. 181905-1 thru 181905-3 (4 p.).

Monroe, J.A., et al., "Direct Measurement of Large Reversible Magnetic-Field-Induced Strain in Ni—Co—Mn—In Metamagnetic Shape Memory Alloys," Acta Materialia, vol. 60 (2012), pp. 6883-6891 (9 p.).

Takenaka, Koshi, "Negative Thermal Expansion Materials: Technological Key for Control of Thermal Expansion," Science and Technology of Advanced Materials, vol. 13 (2012), pp. 1-11 (12 p.).

* cited by examiner

FIG. 1A NiTi
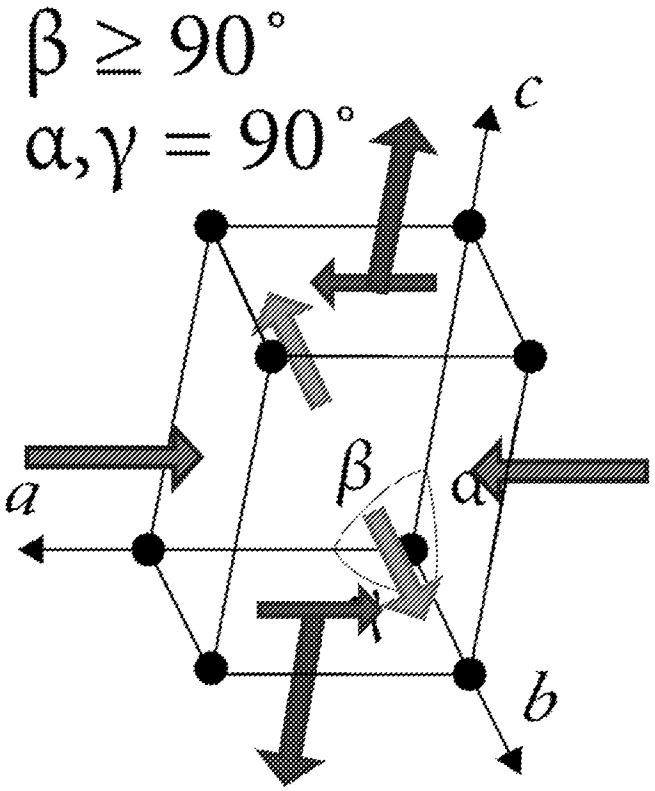

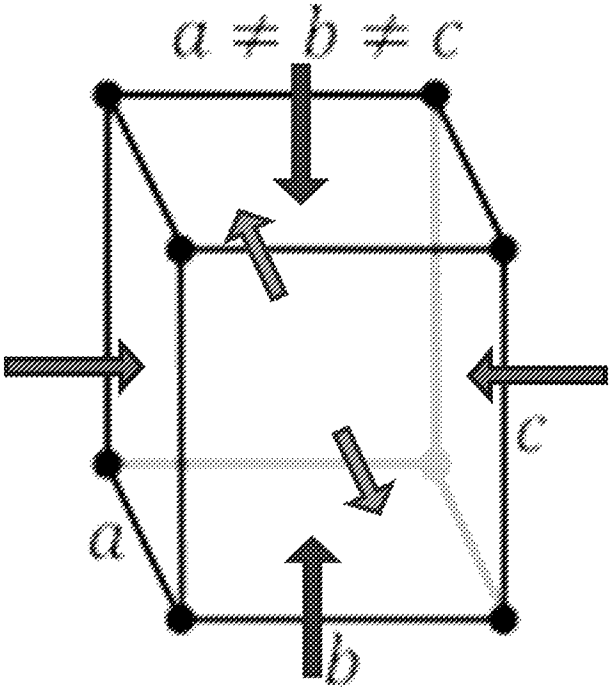
FIG. 1B NiTiPd

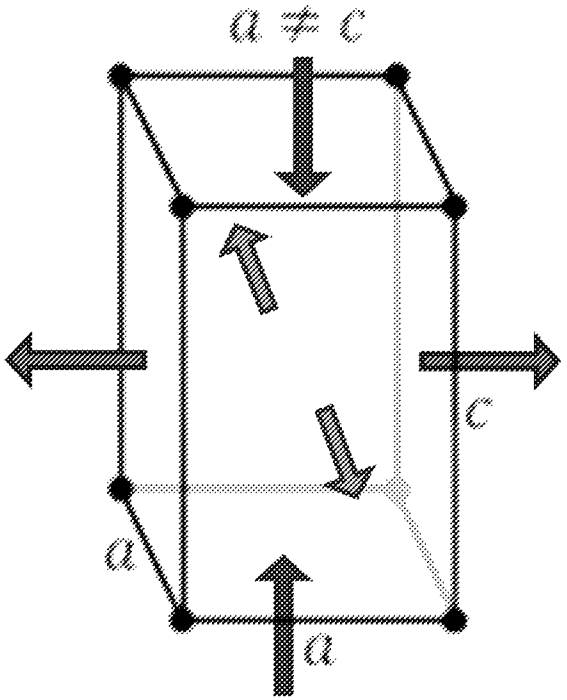
FIG. 1C NiMnGa

FIG. 6A Strain In Wire Direction
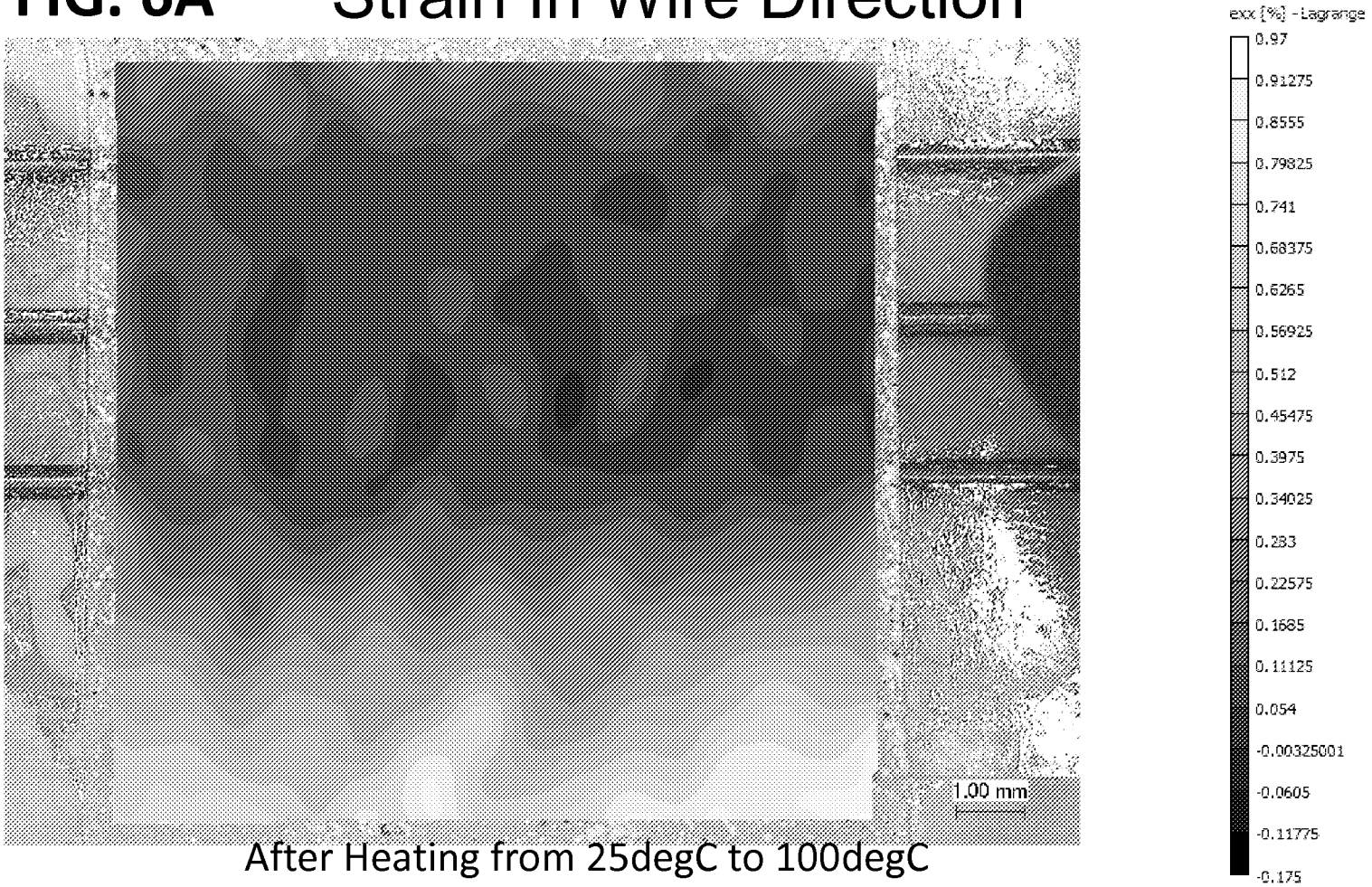
After Heating from 25degC to 100degC Strain Perpendicular to Wire Direction After Heating from 25degC to 100degC

SYSTEMS AND METHODS FOR TAILORING COEFFICIENTS OF THERMAL EXPANSION BETWEEN EXTREME POSITIVE AND EXTREME NEGATIVE VALUES

CROSS-REFERENCE TO RELATED APPLICATIONS

This application is a 35 U.S.C. § 371 national stage application of PCT/US2014/042105 filed Jun. 12, 2014 and entitled "Systems and Methods for Tailoring Coefficients of Thermal Expansion Between Extreme Positive and Extreme Negative Values," which claims benefit of U.S. Provisional Patent App. No. 61/835,289 filed Jun. 14, 2013, and entitled "Systems and Methods for Tailoring Coefficients of Thermal Expansion Between Extreme Positive and Extreme Negative Values," each of which is hereby incorporated herein by reference in its entirety.

STATEMENT REGARDING FEDERALLY SPONSORED RESEARCH OR DEVELOPMENT

This research was sponsored by U.S. National Science Foundation, Division of Materials Research, Metals and Metallic Nanostructures Program, Grant No. 0909170 and Division of Materials Research, Office of Specific Programs, International Materials Institute Program, Grant DMR 08-44082.

BACKGROUND

The disclosure relates generally to the expansion and contraction of materials in response to changes in temperature. More particularly, the disclosure relates to systems and methods for tailoring the coefficients of thermal expansion of metallic materials, and the directionality of thermal expansion and contraction of metallic materials, in response to changes in temperature.

Matter has a tendency to change volume in response to changes in temperature, a phenomenon often referred to as thermal expansion. Most materials respond to a decrease in temperature by contracting (a reduction in volume) and respond to an increase in temperature by expanding (an increase in volume). The degree of thermal expansion of a material is typically characterized by the material's coefficient of thermal expansion, which may be influenced by a variety of factors such as the temperature applied, deformation applied, material composition, as well as any previous processing of that material. Since thermal expansion affects the dimensions of materials subjected to variations in temperature, it can be a significant factor in selecting materials for use in structures and devices.

BRIEF SUMMARY OF THE DISCLOSURE

In an embodiment, a method of manufacturing a metallic material with a thermal expansion coefficient in a predetermined range, comprising: deforming a metallic material comprising a first phase and a first thermal expansion coefficient; transforming, in response to the deforming, at least some of the first phase into a second phase, wherein the second phase comprises martensite; and orienting the metallic material in at least one predetermined orientation, wherein the metallic material, subsequent to deformation, comprises a second thermal expansion coefficient, wherein the second thermal expansion coefficient is within a predetermined range, and wherein the thermal expansion is in at least one predetermined direction.

In an alternate embodiment, a method of manufacturing a metallic material with a thermal expansion coefficient in a predetermined range, comprising: deforming a metallic material by applying tension in a first direction, wherein the metallic material substantially comprises a first phase, and wherein applying the tension transforms at least some of the first phase into a second phase; and wherein, subsequent to deformation, the metallic material comprises a negative coefficient of thermal expansion within a predetermined range, wherein the negative thermal expansion is in at least the first direction.

In an alternate embodiment, method of manufacturing a metallic material with a thermal expansion coefficient in a predetermined range comprising: deforming a metallic material, wherein the metallic material prior to deforming substantially comprises a first phase, and wherein deforming the metallic material transforms at least some of the first phase into a second phase using a compressive force in a first direction; wherein, subsequent to deformation, the metallic material comprises a negative coefficient of thermal expansion within a predetermined range; and wherein, subsequent to deformation, the negative thermal expansion of the metallic material is in at least a second direction, wherein the second direction is perpendicular to the first direction.

In an alternate embodiment, a method of manufacturing a metallic material with a thermal expansion coefficient in a predetermined range, comprising: deforming a metallic material comprising a first thermal expansion coefficient, wherein the metallic material comprises a martensitic phase, wherein the metallic material is oriented in at least one predetermined orientation in response to the deforming; wherein the metallic material, subsequent to deformation, comprises a second thermal expansion coefficient, wherein the second thermal expansion coefficient is within a predetermined range, and wherein the thermal expansion is in at least one predetermined direction.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which:

FIGS. 1A-1C are schematic three-dimensional views illustrating the thermal expansion of monoclinic, orthorhombic, and tetragonal lattice structures according to embodiments of the disclosure.

FIGS. 6A and 6B illustrate a composite material with tailored thermal expansion according to embodiments disclosed herein according to embodiments of the disclosure.

DETAILED DESCRIPTION OF THE PREFERRED EMBODIMENTS

Figure 2:
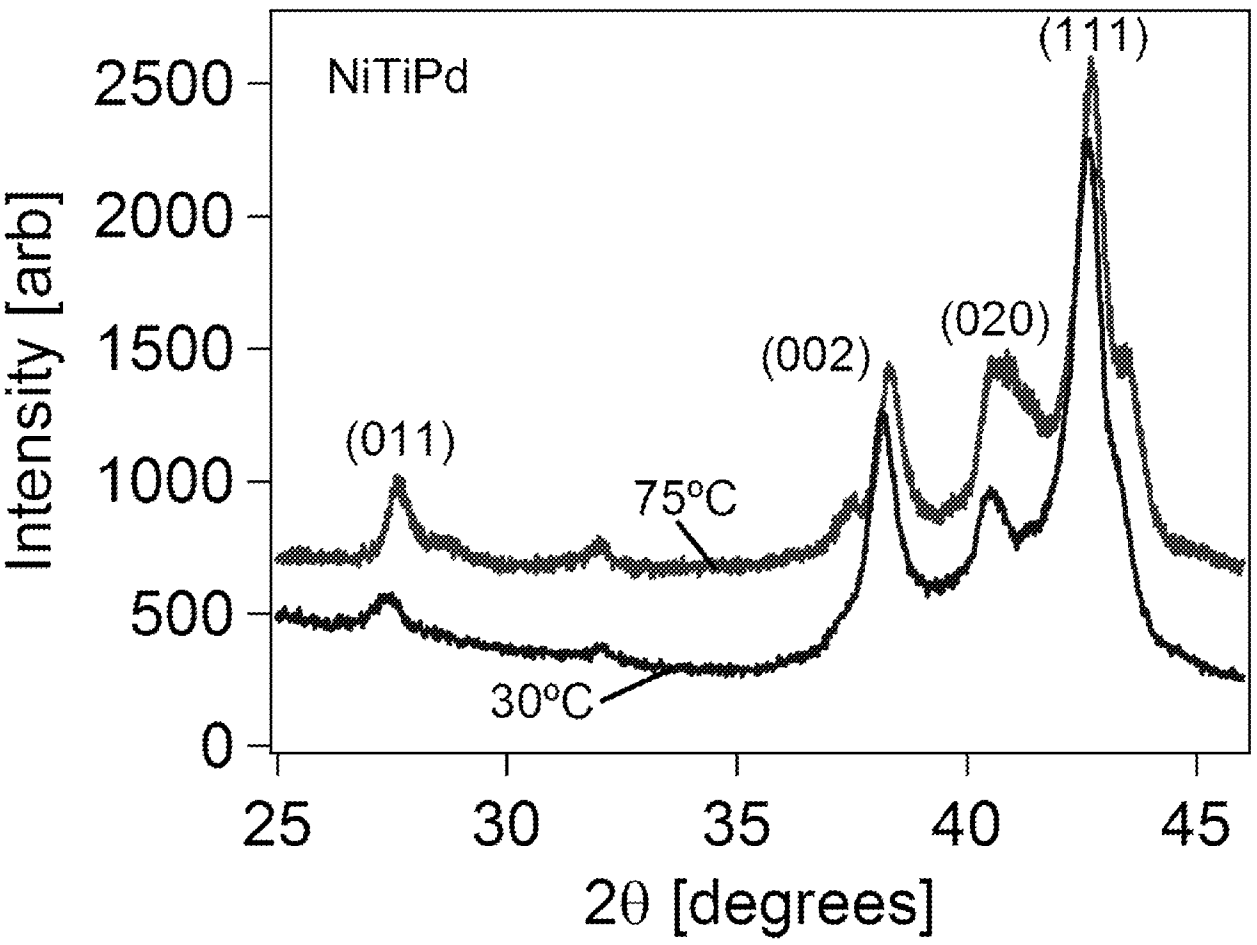
FIG. 2 is a graphical illustration of an x-ray diffraction patterns of an alloy system in a martensitic phase taken at various temperatures according to embodiments of the disclosure.

The following discussion is directed to various exemplary embodiments. However, one skilled in the art will understand that the examples disclosed herein have broad applications, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Materials with negative thermal expansion (NTE) provide interesting technological applications where compensation of positive thermal expansion (PTE) materials is desired and/or required. Unfortunately, most materials exhibiting NTE have low thermal conductivity and fracture toughness (e.g., ceramics), or the NTE response is only linear over a very small temperature range (e.g., invar alloys). As discussed in more detail below, a large NTE or PTE response may occur along different crystallographic directions in the martensitic state of NiTi, NiTiPd and NiMnGa SMAs as well as other materials capable of undergoing a martensitic transformation. This has sparked our interest into the unique thermal-mechanical properties of these materials. Manipulating the martensite's texture in these alloys can result in macroscopic NTE materials that are strong, ductile, and thermally/electrically conductive. This may be referred to as "tailored" thermal expansion since the embodiments of systems and methods disclosed herein can be used to manufacture materials with a thermal expansion coefficient within a predetermined range, at a target, or at a target with a tolerance, and further, can be used to manufacture materials with thermal expansion in a predetermined direction(s) or within a predetermined ranges of degrees relative to a direction.

While most materials contract with decreasing temperature and expand with an increase in thermal temperature, some materials contract with increasing temperature. However, this behavior is usually limited to a certain temperature range or to materials that may not be suitable for a wide range of applications. This contraction upon heating is termed negative thermal expansion (NTE), whereas expansion upon heating is termed positive thermal expansion (PTE). In general, the sign of the coefficient of thermal expansion, positive or negative, indicates whether the thermal expansion is negative or positive, respectively. The terms coefficient of thermal expansion and negative thermal expansion may be used interchangeably herein, it being understood that negative thermal expansion means that the material has a negative coefficient of thermal expansion. Conventionally, a low thermal expansion material such as Invar alloy ($Fe_{64}Ni_{36}$) may be used when negative thermal expansion properties are desired for a particular application. Various grades of Invar may have negative thermal expansion properties near room temperature; $<2\times10^{-6}$ $k^{-1}$ as compared to other metallic materials which are closer to $10–20\times10^{-6}$ $k^{-1}$. However, this negative thermal expansion only occurs over a relatively small temperature range, and further, Invar may have a propensity to creep. Conventionally, ceramic materials may be used if negative thermal expansion is desired for an application. However, these materials typically cannot be used in applications with tension and compression stresses comparable to what a metallic material can withstand, nor in the same extreme conditions as a metallic material.

Embodiments of systems and methods described herein are used to produce metallic materials that, alone or as part of a composite, have tailored thermal expansion properties. More specifically, the material type, composition, phase, processing, or combinations thereof are considered and used in concert to produce a metallic material having a predetermined coefficient of thermal expansion that can be negative or positive. In addition, the direction (in three dimensional space) and extent (degree) of the positive or negative coefficient of thermal expansion are tailored. Although negative thermal expansion is predominantly discussed herein, embodiments of the systems and methods disclosed herein can also be used to tailor positive thermal expansion.

In embodiments described herein, variable thermal expansion properties are obtained from various metallic alloys through processing techniques such as cold rolling, wire drawing, extrusion, tensile loading and several other thermo-mechanical processing techniques. The mechanism responsible for these unique linear thermal expansion properties is different from traditional Invar alloys and can be tailored to a specific application. In general, the linear thermal expansion properties can be varied between extremely negative and extremely positive values, for example, anywhere between $-150\times10^{-6}$ and $+500\times10^{-6}$ $K^{-1}$, by selecting the suitable alloy composition and processing route. By comparison, mild steel has a thermal expansion of $+12$ $10^{-6}$ $K^{-1}$. The unique materials and processing routes disclosed herein allow for new solutions to various engineering problems such as thermal mismatch between silicon chips and packaging in the electronics industry, interconnect failures, mitigation of thermal sagging in overhead power transmission lines, solar panel failures, pipes, plumbing, chemical processing hardware, and thermal expansion valves in various applications including aerospace. In addition, the methods disclosed herein can be used to tailor the coefficient of thermal expansion to be 0 or negative for support cabling as well as pipe couplings and seals for aero, oil and gas, other extreme environments, satellite applications, electronics where there are interconnects, solar panels, power transmission lines, and switches.

In general, embodiments described herein can be applied to alloys that undergo a martensitic transformation such as Fe-, Cu-, Ni-, Ti-, Pd-, Pt-, Mn-, Au-, and Co-based alloys, which have various densities and magnetic, thermal, mechanical, and electrical properties. This allows extreme flexibility in developing tailored thermal expansion alloys for a specific application and at a reduced cost. The alloys processed in accordance with embodiments described herein to tailor their thermal expansion properties are commercially available, or can easily be fabricated with classical metallurgical techniques, as are the processing techniques with respect to the hot and cold-forming deformation discussed herein. It should also be appreciated that methods described herein can also be used to recover/repurpose secondary material, which may have conventionally been sold at a reduced price or even at a loss to the manufacturer. In one embodiment, shape-memory alloys (SMAs) can be processed as described herein to exhibit negative thermal expansion properties.

The universal phenomenon described herein, which enables the tailored thermal expansion properties, is believed to occur in all martensitic SMAs, and has been demonstrated and verified in a variety of metallic materials including NiTi, NiTiPd, NiTiPt, NiMnGa, NiCoMnIn, CoNiGa and FeNiCoAlTa SMAs. These materials represent a variety of element types and crystal structures, which indicates that this is a universal principle of materials that undergo martensitic transformation. Listed below are a variety of materials that undergo martensitic transformation and materials that show martensitic transformation that are considered to have anisotropic thermal expansion properties: NiTi, NiTiX (X=at least one of Pd, Hf, Zr, Al, Pt, Au, or combinations thereof), NiMnX (X=at least one of Ga, In, Sn, Al, Sb, or combinations thereof), NiCoMnX (X=at least one of Ga, In, Sn, Al, Sb, or combinations thereof), NiFeGa, TiNb, TiMo, TiNbX (X=at least one of Al, Sn, Ta, Zr, Mo, Hf, V, O, or combinations thereof), CuMnAlNi, CuMnAl, CuZnAl, CuNiAl, CuAlBe, CoNiX (X=at least one of Al, Ga, Sn, Sb, In, or combinations thereof), TiTaX (X=at least one of Al, Sn, Nb, Zr, Mo, Hf, V, O, or combinations thereof), FeMnX (X=at least one of Ga, Mn, Ni, Co, Al, Ta, Si, or combinations thereof), FeNiCoAlX (X=at least one of Ta, Ti, Nb, Cr, W, or combinations thereof), FeNiCoTi and combinations thereof.

Embodiments of systems and methods disclosed herein utilize some conventional equipment and techniques but in such a way to tailor and expand the range of temperature where tailored and negative thermal expansion occurs in metallic materials other than Invar. Such negative (or positive) thermal expansion properties can be customized and tailored to a predetermined range, target, tolerance target, and direction(s) based upon the method of deformation used and, in some cases, the type of alloy or composite used. This range may be extremely negative, for example, as low as $-150\times10^{-6}$ $K^{-1}$, zero, at or about zero, or extremely positive, for example, as high as $500\times10^{-6}$ $K^{-1}$. In one embodiment, for some applications where two dissimilar materials are structurally connected, it may be desirable to tailor the thermal expansion of one to match the other, even though CTE can be still high positive. It may be desirable to mitigate thermal expansion mismatch by tailoring TE instead of having zero or negative thermal expansion. The temperature range of negative TE, zero TE and tailorable TE may be determined by the austenite to martensite phase transformation temperature of any given material. If this transformation temperature is for example 500° C., then negative TE, zero TE and tailorable TE could be observed from this temperature down to very low temperatures below zero.

As discussed herein, a composite material is one where at least one material capable of a martensitic transformation is embedded in another metal that may or may not be capable of the martensitic transformation, or a ceramic, or a polymer. This mechanism used for tailoring thermal expansion may be explained in a variety of ways as discussed below, including that the martensitic transformation may have previously been difficult to achieve because that mechanism was in competition with dislocation plasticity in the first phase. However, in the systems and methods disclosed herein, the transformation may be more easily achieved if the alloy is strengthened against dislocation plasticity through classical strengthening mechanisms including precipitation hardening, solid solution hardening, dispersion hardening, and grain size refinement. As discussed herein, a composite material may also be a material where at least one material capable of a martensitic transformation, a metal that may or may not be capable of the martensitic transformation, a ceramic, or a polymer, is embedded in a material that has tailored thermal expansion and/or is capable of undergoing a martensitic transformation whether or not it has undergone that transformation when the second material is embedded.

As such, a composite material may broadly be defined as one where at least one of the materials is a metal capable of tailored thermal expansion via martensitic transformation or textured martensite. The goal of this configuration is to impose tailored thermal expansion characteristics to on materials that are incapable of tailored thermal expansion.

By varying the tailored thermal expansion directions, one can obtain very large, very small or zero thermal expansion is specific directions. It is also possible to create composite materials that deform in a pre-determined fashion, such as bending and rotation, by combining PTE and NTE materials in a specific configuration. In one example, the resulting actuators formed from this material would work in a similar fashion to bi-metallic strips that bend when heated due to varying positive thermal expansion coefficients, but the range of deformation possible with our materials would be much larger due to the very large range between PTE and NTE that can be obtained in our materials.

Several processing routes are disclosed to obtain tailored thermal expansion properties in bulk materials, but each generally relies on the fundamental principle of texturing (also referred to as orientating, re-orienting, and de-twinning) the martensitic phase in at least one direction. The bulk material will then have an anisotropic thermal expansion response that is the sum of the various oriented crystallites. The processing techniques include, without limitation: 1) rolling, 2) wire drawing, 3) conventional extrusion, 4) equal channel angular extrusion, 5) precipitation heat treatments under stress, 6) monotonic tension/compression processing, 7) cyclic thermal training under stress (subsequently referred to as SMA training), as well as other thermo-mechanical methods of deformation. Deformation techniques may also include hot-rolling, cold-rolling, plain strain compression, bi-axial tension, conform processing, bending, drawing, swaging, annealing, sintering, monotonic tension processing, monotonic compression processing, monotonic torsion processing, cyclic thermal training under stress, and combinations thereof.

While in some embodiments, a first phase, such as austenite, is transformed in whole or in part to martensite, and therefore materials capable of this transformation would be selected for deformation to achieve a tailored thermal expansion coefficient and direction; in other embodiments, the material is already in a martensitic phase, and thus, no austenite to martensite transformation occurs.

By applying these processing techniques at various temperatures, one can obtain desired macroscopic thermal expansion properties. Rolling, wire drawing and conventional extrusion are very common techniques for metal forming. They rely on plastic deformation by forcing the material through consecutively smaller gaps which usually result in highly textured materials. For example, a very strong [111] texture can be created by extruding or wire drawing a BCC alloy. While known deformation methods may be discussed herein, the use of those methods/techniques to orient/texture martensite variants purely for the purpose of obtaining a pre-determined (tailored) negative thermal expansion is new.

Less common techniques that can be used to texture martensite through plastic deformation are equal-channel-angular extrusion and monotonic tension/compression. For equal-channel-angular extrusion, a metal billet is forced through a 90 degree bend which aligns martensite grains. The advantage to this technique is the material's cross-sectional area is not changed after processing. Monotonic tension or compression involves applying tension or compression forces in a single direction to orient martensite variants.

SMA training forces an oriented martensite structure to be formed upon transformation, and involves holding a sample under constant load and heating/cooling across the martensitic transformation temperatures. This forces small amounts of plastic deformation that favor martensite orientation and can produce a tailored thermal expansion.

In precipitation heat treatments, a material under a load is heated to temperatures sufficient to precipitate small secondary phases that stress the material after cooling. The load orients the precipitates while they are forming. They will in turn orient martensite with the oriented stresses created during cooling.

FIGS. 1A-1C illustrate the thermal expansion for different lattice structures. FIGS. 1A-1C are schematic three-dimensional views illustrating the thermal expansion in the martensite of different monoclinic NiTi, orthorhombic NiTiPd and tetragonal CoNiGa. FIG. 1A displays the thermal expansion directions along the martensite's different crystallographic directions determined from neutron diffraction for NiTi. FIG. 1A illustrates three sides of the structure a, b, and c which also indicate and may be referred to as directions a, b, and c. The arrows show that thermal expansion occurs along the b and c directions while contraction occurs along the a direction. The underlying mechanism for this anisotropy was not previously understood, but an anisotropic statistical thermodynamics based model can predict these directions for various shape memory alloys.

The traditional SMA NiTi has also shown that the low symmetry monoclinic martensitic phase has a large linear NTE along the a-axis and positive thermal expansion (PTE) along the b-axis and c-axis in a 40 K range from known neutron diffraction data that directly examine the plane spacing of the B 19' structure. The thermal expansion tensor determined from this is:

$$\epsilon = \begin{bmatrix} -47.2 & 0 & 29 \\ 0 & 43.8 & 0 \\ 29 & 0 & 22.7 \end{bmatrix} \times 10^{-6} \frac{1}{K}$$

This result shows that NTE and PTE anisotropy is not limited only to alpha Uranium in metals. It is also important to note the large magnitude of these thermal expansion values. In comparison, mild steel has a thermal expansion coefficient ~$12\times10^{-6}$ $K^{-1}$ in the same temperature range. FIG. 1A gives a graphic representation of the strain directions during heating as they relate to the martensite's monoclinic unit cell as determined from known neutron diffraction data. By taking the Eigen values and vectors of the thermal expansion matrix, we can obtain the principle expansion magnitudes and directions:

$$\text{eig_value}(\epsilon) = \begin{bmatrix} -57.7 & 0 & 0 \\ 0 & 43.8 & 0 \\ 0 & 0 & 33.2 \end{bmatrix} \times 10^{-6} \frac{1}{K}$$

$$\text{eig_vector}(\epsilon) = \begin{bmatrix} -0.94 & 0 & -0.34 \\ 0 & 1 & 0 \\ 0.34 & 0 & -0.94 \end{bmatrix}$$

This shows that the maximum linear NTE that can be obtained in martensitic NiTi is $-57.7\times10^{-6}$ $K^{-1}$ and the maximum PTE is $43.8\times10^{-6}$ $K^{-1}$. By taking the trace of the Eigen thermal expansion tensor, a positive volumetric expansion of $19.3\times10^{-6}$ $K^{-1}$ was obtained which shows that while there is contraction in one direction, there is an overall volumetric expansion of the martensite with increasing temperature. The Eigen vectors show that only a small counter clockwise rotation about the b axis is required to obtain the principle thermal expansions.

While the thermal expansion anisotropy provides the potential for NTE materials, randomly oriented variants do not provide macroscopic NTE. To observe this behavior, the trace of the principle thermal expansion tensor must be negative; which has not been observed in any of the alloys explored in this work. As a result, processing is necessary to observe tailored thermal expansion properties at the macroscopic level.

The methods and systems disclosed herein may be utilized on alloys including Fe- and Co-based alloys, Ni-based alloy, shape-memory alloys, and pure materials such as pure Uranium. While in the low temperature martensite phase, the high temperature austenite phase is constantly sampled by random thermal fluctuations. This is similar to the well-established idea that a liquid phase will sample its crystalline form due to random thermal fluctuations, but this sample is quickly destroyed by other random thermal fluctuations. The sampling rate is dependent upon the free energy difference between the two phases and the temperature at which the sampling is taking place. The free energy difference can be thought of the activation energy for sampling while heat is the energy available for sampling. The sampling will then be a random process that can be described by a probability function:

$$f^A = Be^{\frac{-\Delta G^{M\to A}}{RT}}$$

where $f^A$ is the probability of sampling austenite while in the low temperature martensite state where B is a scaling factor, R is the ideal gas constant, T is temperature and $\Delta G^{M\to A}$ is the temperature dependent difference in free energy between the martensite and austenite phases.

The statistical thermodynamic model for anisotropic material is derived from a conventional thermodynamic model for isotropic behavior that describes isotropic negative thermal expansion. However, instead of isotropic volume and generic phases that may or may not be austenite and martensite, the proposed model uses a lattice parameter tensor, $a_{ij}$, and austenite and martensite crystal lattices as described below to understand the anisotropic nature of the thermal expansion. Stated differently, the formula conventionally applied to isotropic materials is applied to anisotropic material:

$$\epsilon_{ij}a_{ij}(T) = \epsilon_{ij}^M a_{ij}^M(T) + f^A(R_{ij}^{A\to M}\epsilon_{ij}^A a_{ij}^A(T) - \epsilon_{ij}^M a_{ij}^M(T)) + \frac{\partial f^A}{\partial T}(R_{ij}^{A\to M}a_{ij}^A(T) - a_{ij}^M(T))$$

where M designates martensite, A designates austenite, $f^A$ is the probability function defined as above, $a_{ij}$ is a tensor describing lattice parameters, $\epsilon_{ij}$ is the thermal expansion tensor and $R_{ij}^{A\to M}$ is a rotation matrix that maps vectors from the austenite to the martensite lattice The function $f^A$ is the probability of sampling austenite while in the low temperature martensite state where B is a scaling factor, R is the ideal gas constant, T is temperature and $\Delta G^{M\to A}$ is the temperature dependent difference in free energy between the martensite and austenite phases. As such, this thermodynamic model has been expanded from the previous work to include anisotropy. This model states that deviation from the martensite phase's thermal response, $\epsilon_{ij}^M\alpha_{ij}^M(T)$, can be obtained by sampling the high temperature phase with a probability of NTE is obtained along crystallographic directions where the austenite lattice is shorter than the martensite lattice and vice versa. This framework has successfully predicted the thermal expansion anisotropy of six SMAs and pure Uranium by comparing austenite and martensite lattice parameters.

FIG. 1B illustrates the direction of thermal expansion in NiTiPd where the crystal structure has 3 sides, a, b, and c. As such, the thermal expansion in the directions a, b, and c are not equal. FIG. 1C illustrates the CoNiGa structure which has two equal sides a and b which are not equal to side c, and the resultant directions of thermal expansion may follow accordingly. Previously, as discussed above, this type of anisotropy had only been found in Uranium and NiTi. Using the systems and methods disclosed herein, anisotropy may also be seen in a plurality of metallic materials that undergo a martensitic transformation.

The martensitic phase may be oriented or texturized to have an anisotropic thermal expansion response that is the sum of the various oriented crystals. Depending upon the material used, this texturizing may be in various directions and may be in whole or in part. In various embodiments, the textured direction may be, for example, [111], [001], or [010].

FIG. 2 is a graphical illustration of x-ray diffraction patterns take at 30° C. and 75° C. of the NiTiPd alloy system in a martensitic phase. FIG. 2 displays diffraction data for a sample of material that is in the martensitic phase, taken from an X-Ray diffractometer using Cu K-α radiation with a constant wavelength λ=1.5418 Å. Each peak in intensity signifies a lattice plane in the martensitic NiTiPd specimen. The peak locations (2θ) allow us to determine the lattice spacing using Bragg's law as defined by the equation:

$$d = \frac{n\lambda}{2\sin\theta}$$

where d is the lattice spacing, λ is the radiation wavelength, θ is the angle between the radiation source and the lattice planes (taken from the peak location in FIG. 2), and n is an integer. It is important to note that the angle θ and thus the d value does not depend on the sample's orientation in 3-D space. The peak locations shift with temperature, and thus, the thermal expansion coefficients can be calculated from these diffraction results. This is true for all diffraction techniques, such as high energy x-ray, electron and neutron diffraction, that measure lattice spacing.

While the peak locations indicate the lattice planar spacing, the peak intensity, or height, indicates the number of planes oriented in a particular direction within the sample. This intensity is then used to determine texture; the orientation of martensite variants, or crystallites, within the sample.

Calculating Coefficients of Thermal Expansion:

To determine the thermal expansion along different crystallographic directions, diffraction patterns were taken between 30° C. and 100° C., as an example, and the lattice strain defined as:

$$\varepsilon_{lattice} = \frac{d_{T>30^\circ C.} - d_{T=30^\circ C.}}{d_{T=30^\circ C.}}$$

where $d_{T>30^\circ C.}$ is the lattice spacing at temperatures above 30° C., $d_{T=30^\circ C.}$ is the original lattice spacing at 30° C. It should be noted that these diffraction test were conducted under 0 MPa.

Figure 3A:
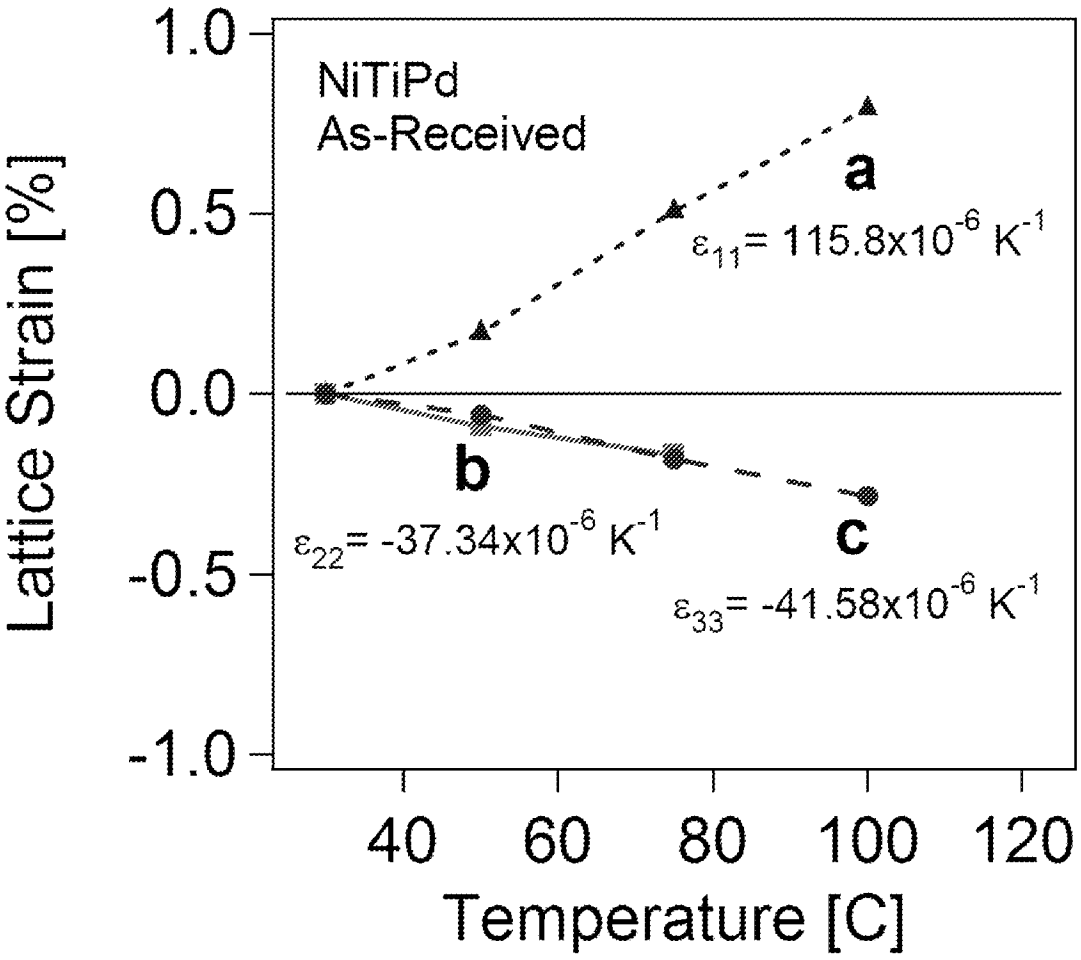
FIG. 3A shows the thermally induced lattice strain calculated using x-ray diffraction under 0 MPa according to embodiments of the disclosure.

FIG. 3A shows the thermally induced lattice strain calculated using x-ray diffraction under 0 MPa. More specifically, FIG. 3A shows the thermally induced lattice strain of the NiTiPd calculated using x-ray diffraction similar to FIG. 2 under 0 MPa.

FIG. 3A displays a lattice strain vs. temperature plot for martensite lattice parameters a, b and c and austenite lattice parameter $a_0$ calculated using the lattice spacing determined from diffraction results. Please note the a, b and c lattice parameters correspond to the [100], [010] and [001] crystallographic directions in the crystal lattice of martensite, respectively. It is clearly evident that the [100] (a) direction expands greatly while the [010] and [001] (b and c) directions contract showing the thermal expansion anisotropy of this material. The thermal expansion matrix ($\epsilon_{ij}$) for the material between 30° C. and 100° C. is given by:

$$(\epsilon_{ij})_{NiTiPd} = \begin{bmatrix} \epsilon_a & 0 & 0 \\ 0 & \epsilon_b & 0 \\ 0 & 0 & \epsilon_c \end{bmatrix} = \begin{bmatrix} 115.8 & 0 & 0 \\ 0 & -37.34 & 0 \\ 0 & 0 & -41.58 \end{bmatrix} \times 10^{-6} \frac{1}{K}$$

where $\epsilon_a$, $\epsilon_b$ and $\epsilon_c$ are the thermal expansion coefficients for the [100], [010] and [001] directions, respectively. Note the negative thermal expansion in the two directions.

Figure 3B:
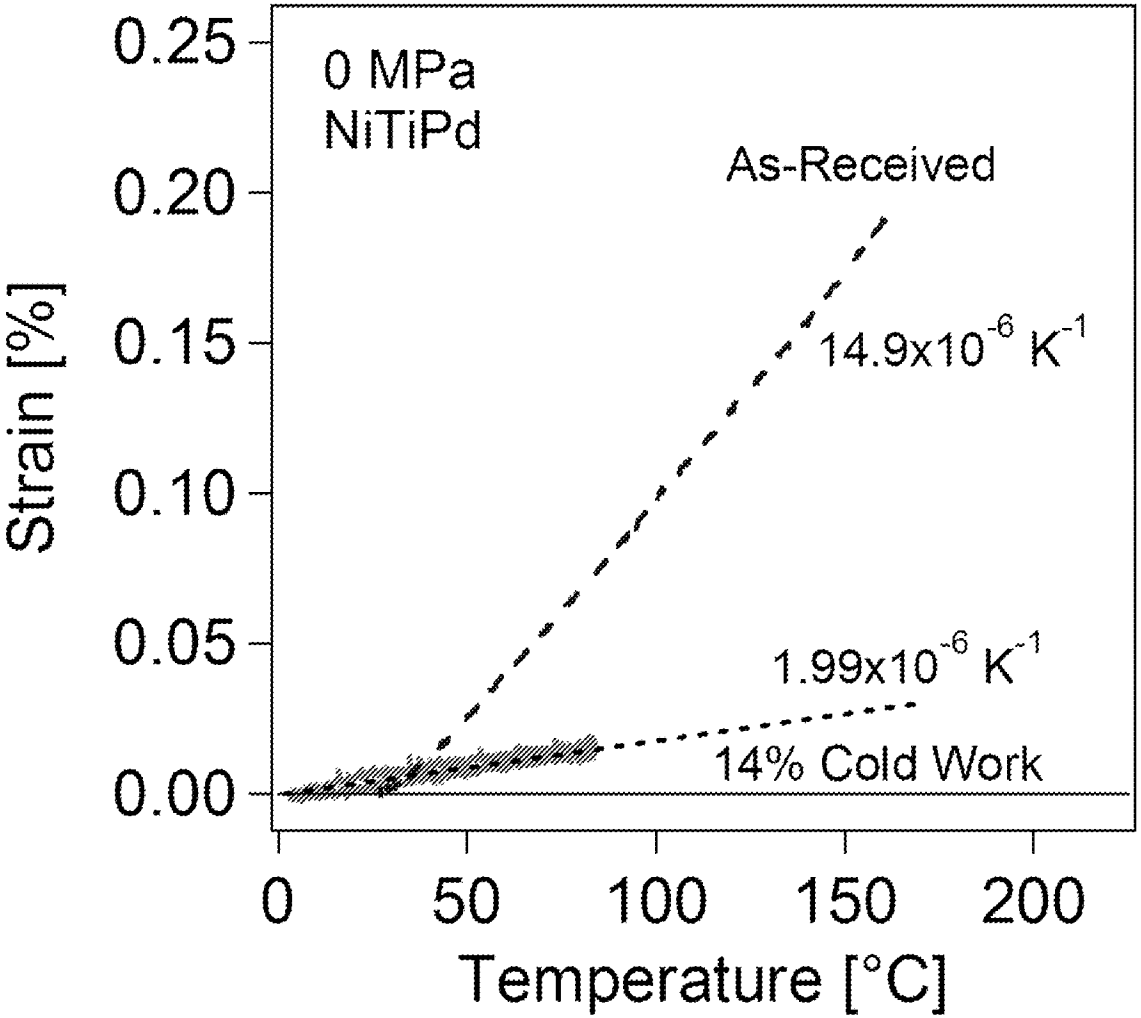
FIG. 3B is a graphical illustration of macroscopic strain v. temperature and the corresponding thermal expansion of an unprocessed, 14% cold rolled, SMA trained and 200 MPa loaded NiTiPd material according to embodiments of the disclosure.

FIG. 3B is a graphical illustration of macroscopic strain v. temperature and the corresponding thermal expansion of an unprocessed, 14% cold rolled, SMA trained, and 200 MPa loaded NiTiPd material. Interestingly, the unprocessed (as-received) thermal expansion is positive at $14.9\times10^{-6}K^{-1}$ (also expressed as 1/K) which is similar to the $\sim12\times10^{-6}$ $K^{-1}$ thermal expansion shown by mild steel. It is appreciated that "as-received material" as used herein refers to material that has been formed but not further thermo-mechanically processed. This is explained by a randomly oriented martensite crystal structure. When the material is loaded to 200 MPa, the load orients martensite and a $-4.69\times10^{-6}K^{-1}$ NTE is observed. This proves that a tailored thermal expansion can be sustained under external loads. After 200 SMA training cycles, the material exhibits a $-7.3\times10^{-6}K^{-1}$ NTE when tested under 0 MPa showing the NTE stability after a biased load is removed. Rolling to 14% did not produce a negative thermal expansion, but a drastic reduction to $1.99\times10^{-6}$ $K^{-1}$ was achieved. It is appreciated that this response is better than super invar alloy which has a thermal expansion coefficient of $2.3\times10^{-6}K^{-1}$.

To perform texture analysis, one may focus on a single peak and see how its intensity changes as the sample is rotated in three dimensions. Since the sample is at room temperature during the analysis, the peak location does not change. FIG. 2 displays the as-received texture of the NiTiPd sample using the [111] and [002] peaks. It is important to collect data on at least two peaks in order to successfully check the orientation of the crystal lattice inside the sample. The hotter colors in the image correspond to greater peak intensity. This data suggests that the [111] planes and [002] planes are perpendicularly spread between the transverse direction (TD) and normal direction (ND). The ND is not labeled but is the direction coming out of the page. While tension and compression as well as an embedded matrix embodiment are discussed herein, a variety of thermo-mechanical processes can be used alone or in combination to generate the phase transformation to martensite, or that material already in the martensitic phase may be textured (oriented) in order to generate the tailored thermal expansion coefficient and the directionality of that thermal expansion.

Figure 4A:
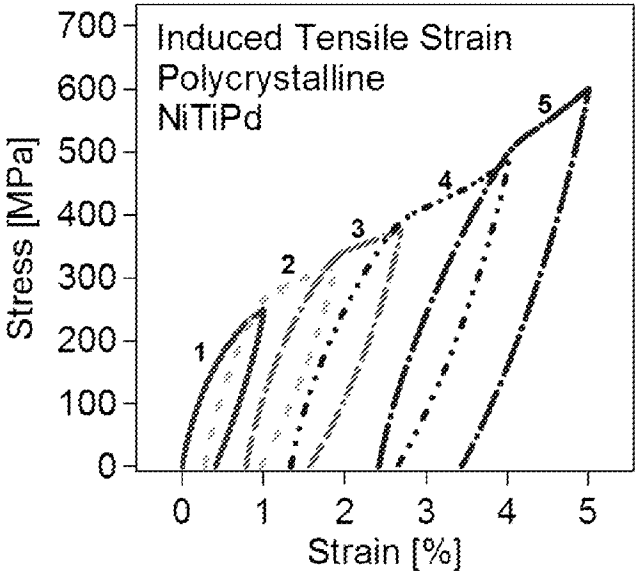
FIGS. 4A-4C are graphical illustrations of a monotonic tension processing scheme and resulting thermal expansion responses for NiTiPd according to embodiments of the disclosure.
Figure 4B:
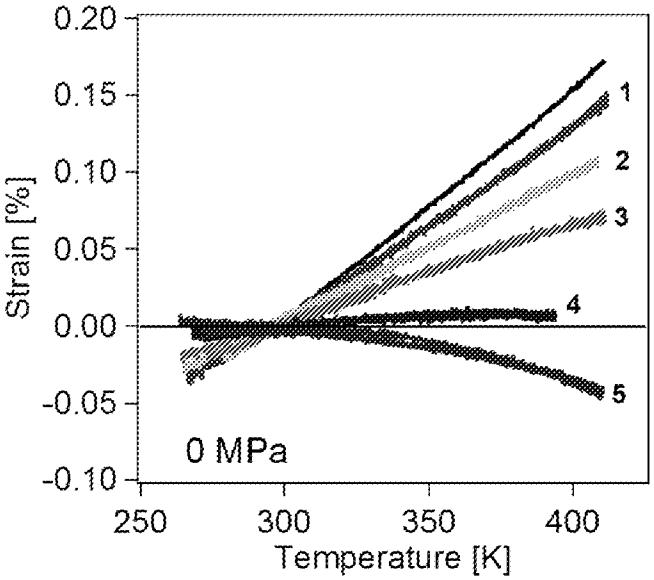
Figure 4C:
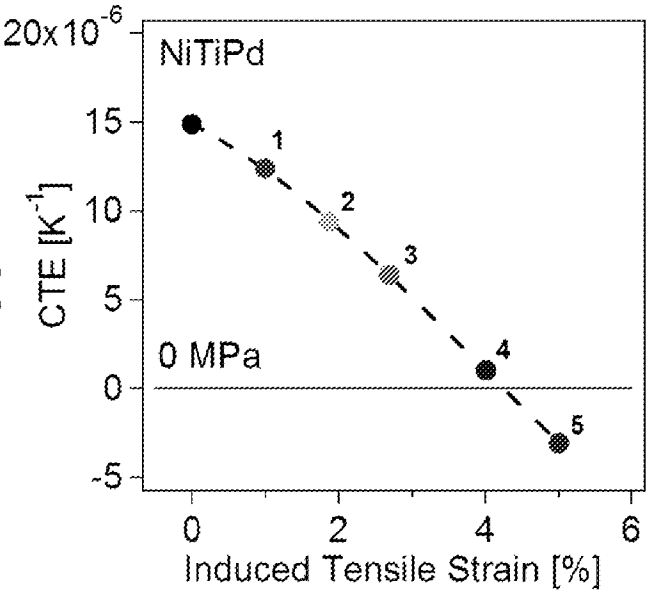

FIGS. 4A-4C illustrate the results of a monotonic tension processing scheme and resulting thermal expansion responses. It is appreciated that these figures are provided for illustration as to the mechanism is not limited to the martensitic NiTiPd alloy used in the illustrations. FIGS. 4A-4C illustrate the mechanism as it occurs under tension, the mechanism as it occurs under cold-rolling is discussed below in FIGS. 5A-5D. FIG. 4A illustrates the stress-strain curve for incrementally tensile-processed sample where the sample was put under a tensile load that was incrementally increased. FIG. 4B illustrates the heating-cooling response at 0 MPa after the load was removed subsequent to the incremental tensile processing. The sample was heated and cooled under 0 MPa, FIG. 4B after being subjected to the incremental strains shown in FIG. 4A. FIG. 4B illustrates that a tailored thermal expansion coefficient can be obtained by varying the degree of initial strain and that a negative thermal expansion can ultimately be reached. In one example using NiTiPd, this wide temperature range of at least up to 150° C. of linear thermal expansion is larger than that of super Invar alloys; which is limited to between 0° C. and 100° C. In other examples, this range may be larger. FIG. 4C shows the thermal expansion coefficient vs. the maximum applied tensile strain. This figure illustrates that the macroscopic thermal expansion coefficient is linearly related to the amount of induced strain and the crossover from positive to negative thermal expansion occurs just above 4% strain.

FIGS. 5A-5D are illustrations of pole figures before and after cold-working the material. More specifically, FIGS. 5A-5D are graphical illustrations of pole figures before and after cold-working an exemplary material where 502 is the transverse direction, 504 is the extrusion direction and 506 is the rolling direction.

Figure 5A:
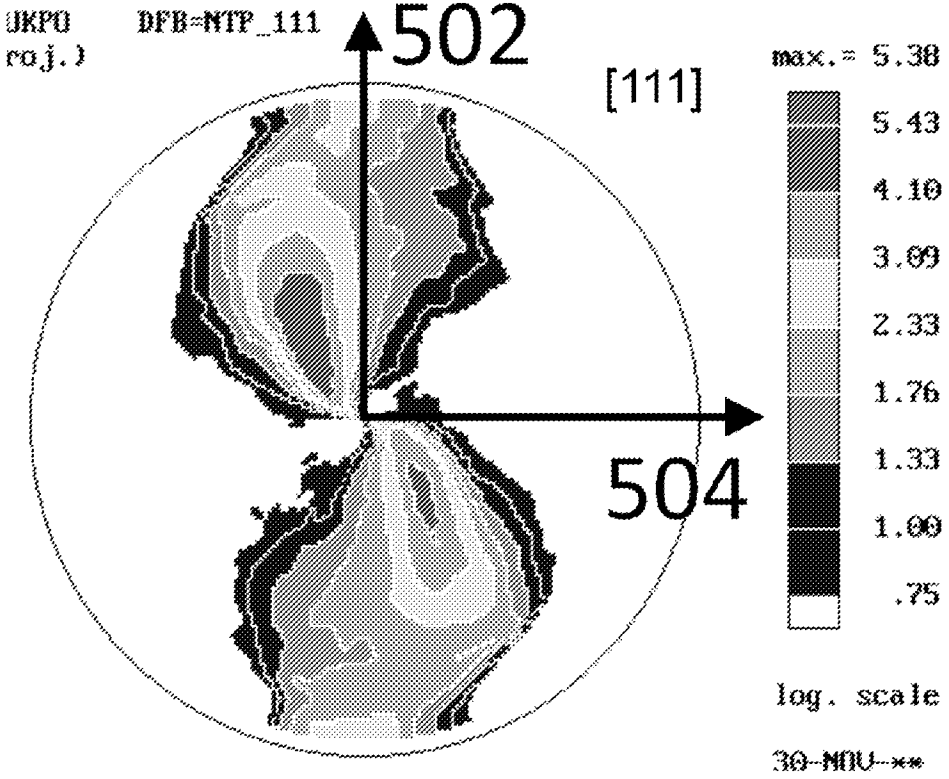
FIGS. 5A-5D are graphical illustrations of pole figures before and after cold-working an exemplary material according to embodiments of the disclosure.
Figure 5B:
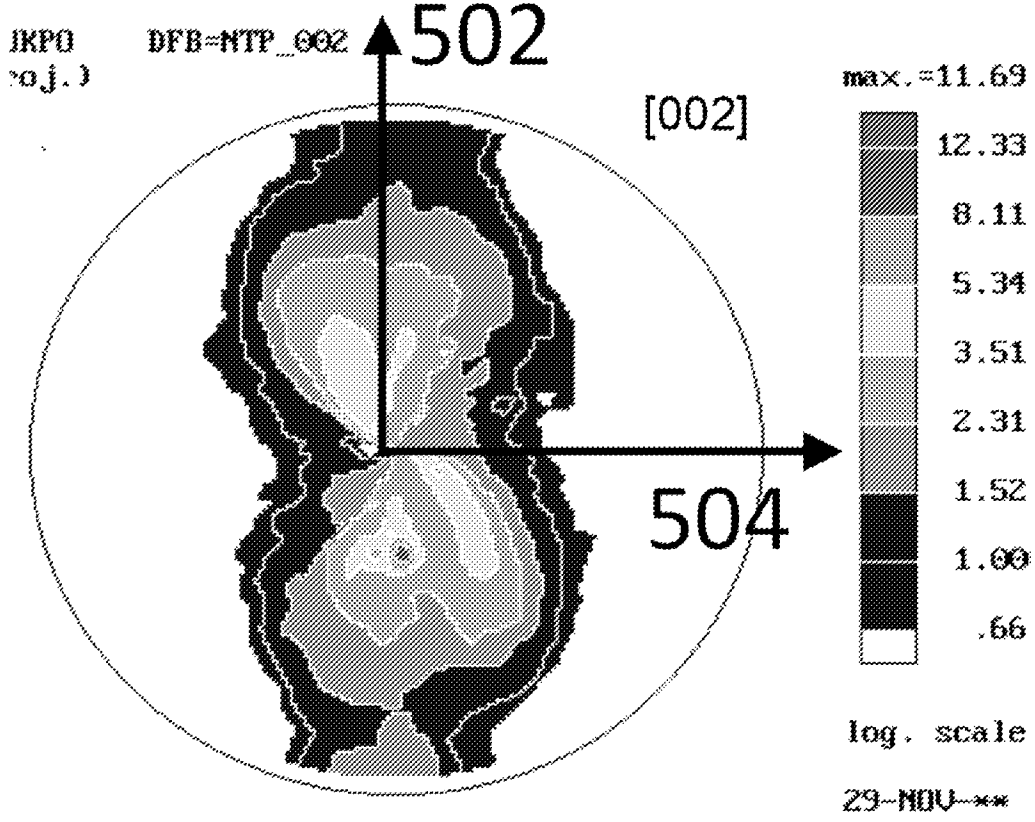

In addition to tension and other thermo-mechanical deformation techniques discussed above, a tailored thermal expansion may also be achieved via cold rolling (or compression). FIGS. 5A and 5B are pole figures which display the [111] and [002] for orthorhombic martensite in the as-received material condition. As-received condition in this particular case is hot-extruded condition, where the material was hot extruded at 900° C. The extrusion direction 504 (ED) and transverse direction 502*l* (TD) correspond to the hot extruded directions performed prior to cutting the samples. It is evident that the [111] in FIG. 5A and [002] planes in FIG. 5B are not oriented along the extruded direction 504 and are instead they are oriented between the transverse direction 502 and the center of the pole figure.

Figure 5C:
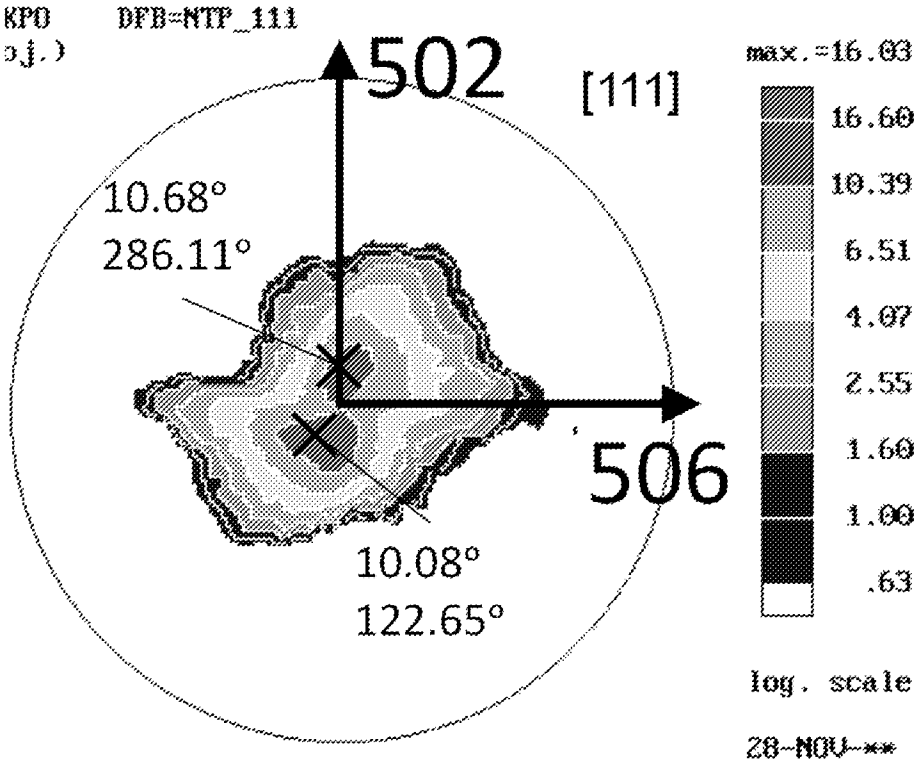
Figure 5D:
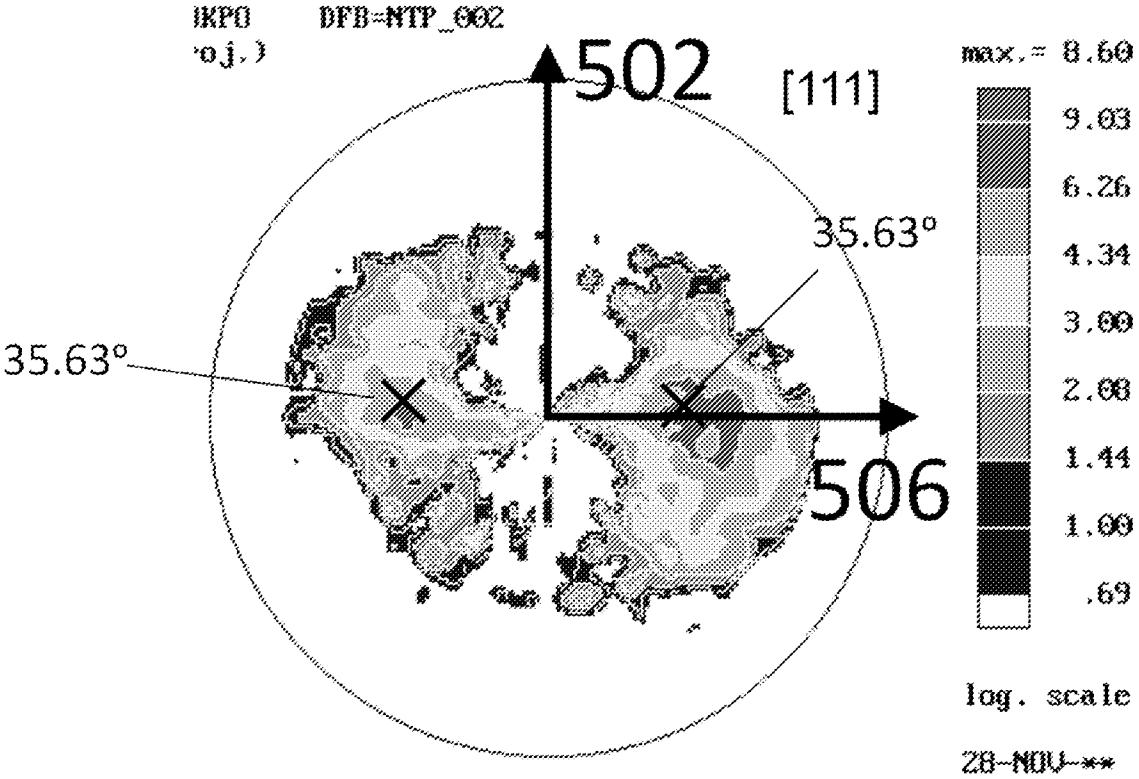

FIGS. 5C and 5D show the poles after cold-rolling. After cold-rolling, the sample's texture change. It should be noted that the rolling direction (RD) 506 is in the same direction as the 504 ED for the as-received material. The cold rolling produced significant [111] texturing along the normal direction (ND) while orienting the [002] planes along the RD 506. A distinct 180° rotational symmetry along the rolling direction axis is evident and may be a result of the original texture.

Comparison of the thermal expansion is displayed in FIG. 3B. The initial thermal expansion is $14.9\times10^{-6}$ $K^{-1}$ which changes drastically to $1.99\times10^{-6}$ $K^{-1}$ with only 14% cold work. This is a lower thermal expansion coefficient than super invar alloy at $2.5\times10^{-6}$ $K^{-1}$ in the same temperature range. Interestingly, the thermal expansion properties were isotropic in the rolling plane. This is thought to occur due to the fan-like texture observed for the [002] plane after rolling (FIG. 5D). The strong [111] texture aligns the positive thermal expansion direction, [010], mostly along the ND and aligns the NTE directions, [100] and [001], mostly along the RD 506 and TD 502.

Figure 6B:
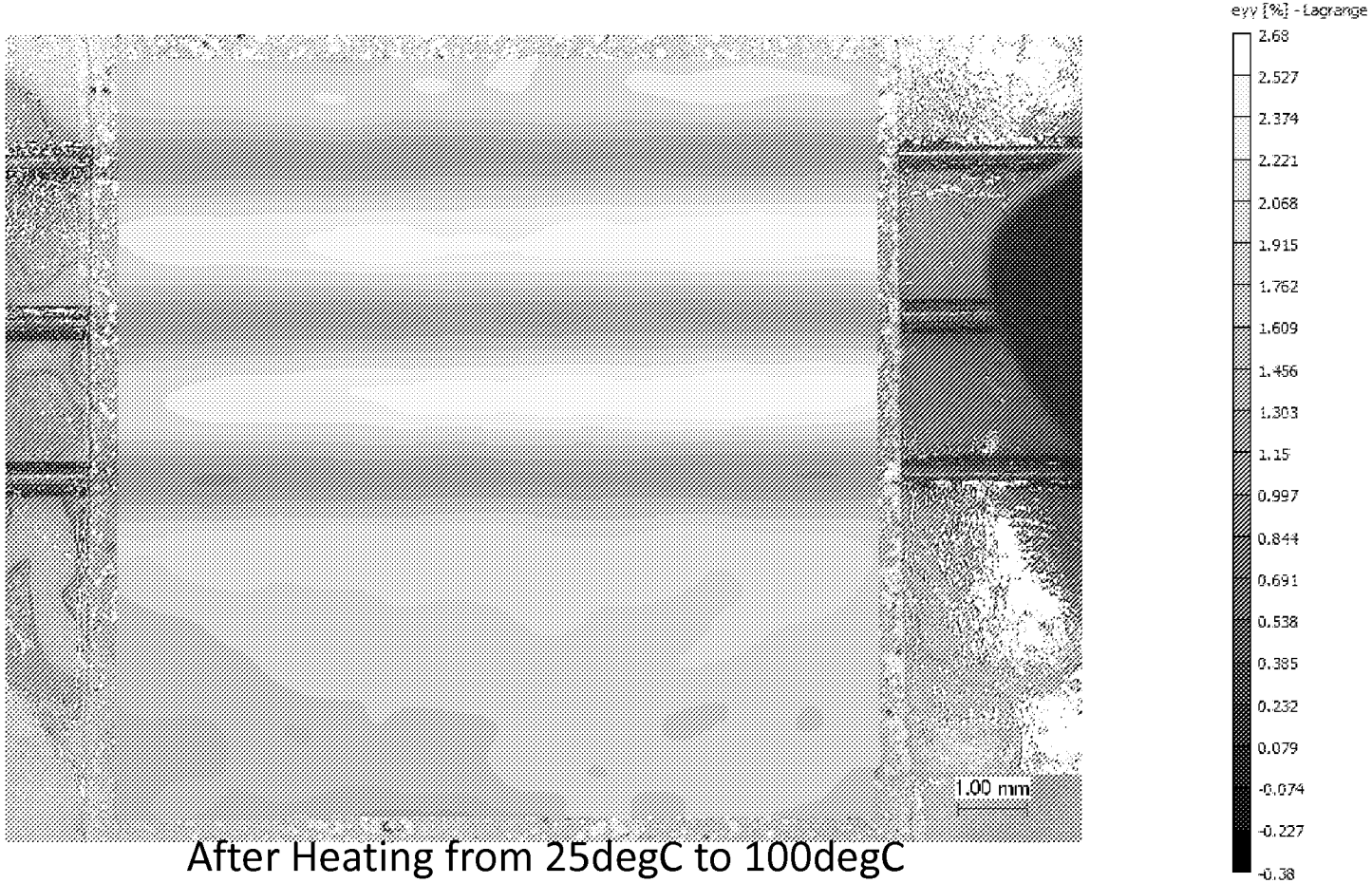

FIGS. 6A and 6B demonstrate a composite with tailorable thermal expansion according to embodiments disclosed herein. In FIGS. 6A and 6B, a wire was first hot extruded and may not have had a desired texture in martensite initially. Subsequently, the wire was thermo-mechanically trained, segmented, and embedded in epoxy to form a composite material. The temperature was then increased incrementally and images were taken to track the strain on the surface to demonstrate the behavior of the composite. FIG. 6A tracks $\epsilon_{xx}$ and illustrates the strain along the wire direction which is the direction along which the wire was trained under tension. FIG. 6B illustrates the strain in the direction of $\epsilon_{YY}$ which is the direction perpendicular to the direction of the wire-drawing. Both FIGS. 6A and 6B show heating from 25° C.-100° C., and show no change in length in FIG. 6A, and FIG. 6B shows that there is only strain in the perpendicular direction along the wire.

While FIGS. 6A and 6B illustrate a material that has undergone martensite texturing (reorienting) embedded in a polymer to form a composite material, either a material that has undergone a martensitic transformation or a material that has been texturized while in the martensitic phase may be used to form a composite material. The composite material may be formed using polymer, ceramics, other metals, other metals capable of undergoing a martensitic transformation, and combinations thereof as appropriate for a particular application and/or end use.

Figure 7:
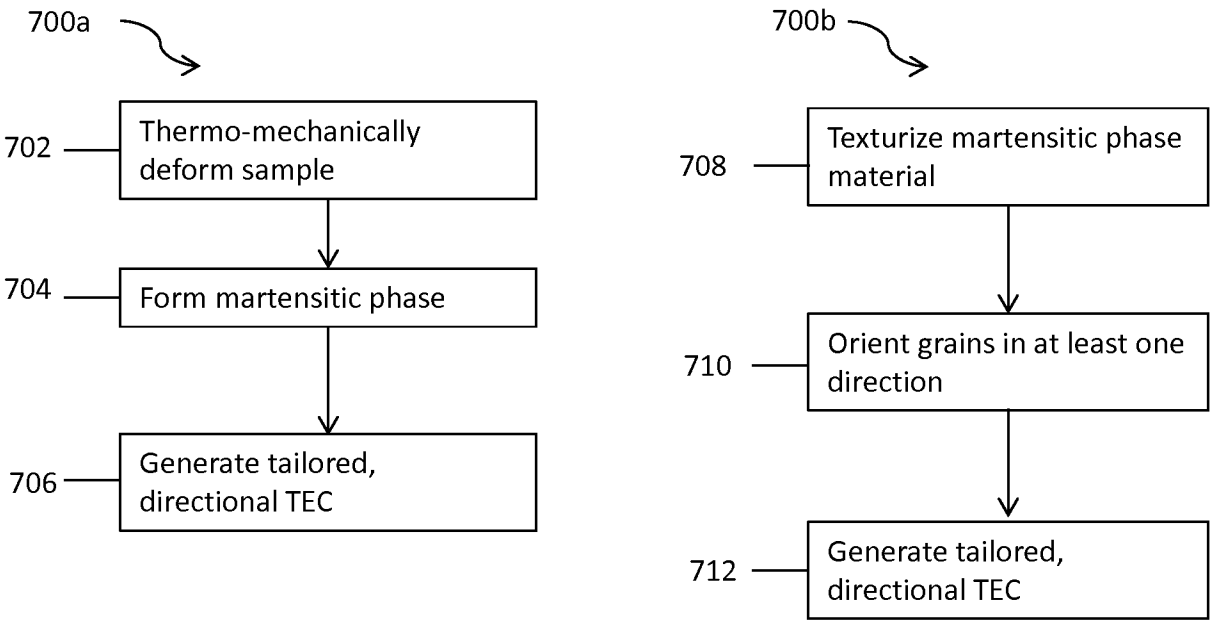
FIG. 7 illustrates two embodiments of methods for tailoring thermal expansion according to embodiments disclosed herein according to embodiments of the disclosure.

FIG. 7 illustrates two methods 700*a* and 700*b* for tailoring the thermal expansion properties of a material. In method 700*a*, a metallic material such as a shape-memory alloy or other alloy capable of undergoing a martensitic transformation is thermo-mechanically deformed at block 702 in order to obtain a tailored thermal expansion coefficient and direction at block 706. In one example, NiTiPt wire was used. The term "tailored" as discussed herein refers to the ability of the methods and systems disclosed herein to produce a thermal expansion coefficient within a predetermined range or to a particular value, or to a particular value with a tolerance. In addition, the term "tailored" may be used to refer to the direction of the thermal expansion. Depending upon the type of thermo-mechanical deformation used at block 702 as discussed below, the thermal expansion coefficient may be highly positive or very negative, for example, from about $-150\times10^{-6}$ $K^{-1}$ to about $500\times10^{-6}$ $K^{-1}$. As used herein, the term "about" means variation in results/properties that may result from manufacturing conditions, where the "about" values are values that are desirable and obtained from the process disclosed herein, and are values that are appropriate for the end application. In an embodiment, the metallic material may comprise one or more phases and the deformation at block 702 transforms substantially all of the metallic material undergoes a transformation to the martensitic phase at block 704. The method of thermo-mechanical deformation used may depend on the direction and value of the thermal expansion coefficient desired, as well as what material and material composition are used. At block 706, in response to the formation of the martensitic phase at block 704, the material exhibits a tailored coefficient of thermal expansion which may also, as discussed above, be described as falling into a predetermined range, a target, or a target with a tolerance. The tailored coefficient of thermal expansion may also be in a predetermined direction or directions which, as discussed above, may be related to the direction or directions of thermo-mechanical deformation in block 702.

As discussed above, the metallic material may comprise any material capable of undergoing a martensitic transformation including but not limited to: NiTi, NiTiPd, NiTiHf, NiTiPt, NiTiAu, NiTiZr, NiMn, NiMnGa, NiMnSn, NiMnIn, NiMnAl, NiMnSb, NiCoMn, NiCoMnGa, NiCoMnSn, NiCoMnAl, NiCoMnIn, NiCoMnSb, NiFeGa, MnFeGa, TiNb, TiMo, TiNbAl, TiNbSn, TiNbTa, TiNbZr, TiNbO, TiTa, TiTaZr, TiTaAl, TiTaO, CuMnAlNi, CuMnAl, CuZnAl, CuNiAl, CuAlBe, CoNi, CoNiAl, CoNiGa, FeMn, FeMnGa, FeMnNi, FeMnCo, FeMnAl, FeMnTa, FeMnNiAl, FeNiCoAl, FeNiCoAlTa, FeNiCoAlTi, FeNiCoAlNb, FeNiCoAlW, FeNiCoAlCr, FeMnSi, FeNiCo, FeNiAl, FeNiCoTi, as well as derivations and combinations thereof.

Turning to method 700*b*, method 700*b* in FIG. 7 begins at block 708 where the metallic material substantially comprises a martensitic phase. At block 710, substantially all or part of the metallic material is oriented in at least one predetermined direction. The predetermined direction may be [001], [111], [010], or other directions depending upon the material and the method of thermo-mechanical deformation used to orient the material. It is appreciated that the orientation at block 710 may also be described as texturizing, texturing, or de-twinning the material. At block 712, in response to the orientation at block 710, the metallic material has a tailored coefficient of thermal expansion and may be in a direction as discussed above with respect to block 706 in method 700*a*.

The thermo-mechanical deformation technique employed at block 704 for the martensitic transformation and/or at block 710 for grain orientation may be a single technique or may be a combination of techniques. These techniques may include but are not limited to: hot-rolling, cold-rolling, wire drawing, plain strain compression, bi-axial tension, conform processing, bending, drawing, swaging, conventional extrusion, equal channel angular extrusion, precipitation heat treatment under stress, tempering, annealing, sintering, monotonic tension processing, monotonic compression processing, monotonic torsion processing, cyclic thermal training under stress, and combinations thereof.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method of manufacturing a metallic material with a tailored thermal expansion coefficient in a selected range, comprising:

plastically deforming said metallic material comprising a first phase and a first thermal expansion coefficient;

transforming, in response to said plastic deforming, at least some of said first phase into a second phase; and orienting said metallic material in at least one selected orientation;

wherein:

said metallic material comprises an alloy with a mixture of phases;

said mixture of phases comprises at least one phase capable of a martensitic transformation that is embedded in another phase or phases that may or may not be capable of martensitic transformation;

said second phase comprises martensite;

said plastic deforming comprises mechanical deformation;

said metallic material, subsequent to said plastic deformation, comprises a second thermal expansion coefficient;

said second thermal expansion coefficient is within a selected range; and said second thermal expansion coefficient quantifies thermal expansion of said metallic material in at least one selected direction.

2. The method of claim 1, wherein said plastic deforming of said metallic material comprises applying tension in at least one direction, wherein the tailored thermal expansion of said metallic material subsequent to said plastic deforming of said metallic material is in the at least one direction in said metallic material.

3. The method of claim 1, wherein said plastic deforming of said metallic material comprises applying compression in a first direction, wherein the tailored thermal expansion of said metallic material subsequent to said plastic deforming of said metallic material is in at least one selected direction, and wherein said selected direction is perpendicular to said first direction.

4. The method of claim 1, wherein said plastic deforming of said metallic material comprises applying shear in a first direction, wherein the tailored thermal expansion of said metallic material subsequent to said plastic deforming of said metallic material is in at least one selected direction, and wherein said selected direction is 45° to said first direction.

5. The method of claim 4, wherein said metallic material comprises:

NiTi, NiFeGa, TiNb, TiMo, CuMnAlNi, CuMnAl, CuZnAl, CuNiAl, FeNiCoTi, CuAlBe, or is at least one of:

characterized by a general formula NiTiX, wherein X is at least one of Pd, Hf, Zr, Al, Pt, Au;

characterized by a general formula NiMnX, wherein X is at least one of Ga, In, Sn, Al, Sb;

characterized by a general formula NiCoMnX, wherein X is at least one of Ga, In, Sn, Al, Sb;

characterized by a general formula TiNbX, wherein X is at least one of Al, Sn, Ta, Zr, Mo, Hf, V, O;

characterized by a general formula CoNiX, wherein X is at least one of Al, Ga, Sn, Sb, In;

characterized by a general formula TiTaX, wherein X is at least one of Al, Sn, Nb, Zr, Mo, Hf, V, O;

characterized by a general formula FeMnX, wherein X is at least one of Ga, Mn, Ni, Co, Al, Ta, Si;

characterized by a general formula FeNiCoAlX, wherein X is at least one of Ta, Ti, Nb, Cr, W;

and combinations thereof.

6. The method of claim 1, wherein said plastic deforming is achieved by at least one of hot-rolling, cold-rolling, wire drawing, plane strain compression, bi-axial tension, conform processing, bending, drawing, wire-drawing, swaging, conventional extrusion, equal channel angular extrusion, precipitation heat treatment under stress, tempering, annealing, sintering, monotonic tension processing, monotonic compression processing, monotonic torsion processing, cyclic thermal training under stress, and combinations thereof.

7. A method of manufacturing a metallic material with a tailored thermal expansion coefficient in a selected range, comprising:

plastically deforming a metallic material comprising a first thermal expansion coefficient;

wherein:

said metallic material comprises an alloy;

said metallic material is comprised of a martensitic phase with or without the presence of other phases;

said plastic deforming comprises mechanical deformation;

said martensitic phase in said metallic material is oriented in at least one selected orientation in response to said mechanical deforming;

said metallic material, subsequent to said plastic deforming, comprises a second thermal expansion coefficient due to said orientation;

said second thermal expansion coefficient is within a selected range; and said second thermal expansion coefficient quantifies thermal expansion of said metallic material in at least one selected direction.

8. The method of claim 7, wherein said plastic deforming is achieved by at least one of hot-rolling, cold-rolling, wire drawing, plane strain compression, bi-axial tension, conform processing, bending, drawing, wire-drawing, swaging, conventional extrusion, equal channel angular extrusion, precipitation heat treatment under stress, tempering, annealing, sintering, monotonic tension processing, monotonic compression processing, monotonic torsion processing, cyclic thermal training under stress, and combinations thereof.

9. The method of claim 7, wherein said alloy is oriented in a direction comprising at least one of a [111], [100], or [001] direction.

* * * * *